US005084948A

United States Patent [19]

Nielsen et al.

[11] Patent Number: 5,084,948

[45] Date of Patent: Feb. 4, 1992

[54] TEXTILE NAPPING MACHINE

[75] Inventors: Arne Nielsen, Oak Ridge; Majid Moghaddassi, Greensboro, both of N.C.

[73] Assignee: Guilford Mills, Inc., Greensboro, N.C.

[21] Appl. No.: 539,623

[22] Filed: Jun. 18, 1990

[51] Int. Cl.[5] ..... D06C 11/00

[52] U.S. Cl. ..... 26/32; 26/29 R; 26/25

[58] Field of Search ..... 26/25-35

[56] References Cited

U.S. PATENT DOCUMENTS

| | | | |
|---|---|---|---|
| 350 | 8/1837 | Swasey | 26/32 |
| 810,273 | 1/1906 | Greene | 26/33 |
| 943,167 | 12/1909 | Shaw | 26/27 |
| 1,154,350 | 9/1915 | Thiel | 26/33 |
| 1,703,774 | 2/1929 | Lowder . | |
| 1,880,486 | 10/1932 | Richardson | 26/32 |
| 1,968,963 | 8/1934 | Schiffers | 26/33 |
| 2,120,576 | 6/1938 | Scholaert | 26/34 |
| 2,697,265 | 12/1954 | Corson | 26/31 |
| 3,174,205 | 3/1965 | Bertrand | 26/33 |
| 3,373,468 | 3/1968 | Müllers | 26/33 |
| 4,468,844 | 9/1984 | Otto | 26/28 |
| 4,631,788 | 12/1986 | Dischler et al. | 26/25 |
| 4,803,761 | 2/1989 | Lungers | 26/35 |

OTHER PUBLICATIONS

Reisfeld, A., "Warp Knit Fabric Design—part 6", *Knitting Times*, pp. 34-42, Aug. 16, 1976.

Howarth, Dr. Eric, "New Techniques in Fabric Raising", *Knitting Times*, pp. 11-13, Jul. 9, 1979.

Boh, Christan, "Raised Fabrics", *WST Knitting Technic*, vol. 5 (1983), No. 4, pp. 335-336.

Nakano, Ogita Y., "The Action of Raising Card Clothing for the Cloth", Reprint from Journal of the Textile Machinery Society of Japan, vol. 37, No. 5 (May, 1984).

Ogita, Y./Uchida, Y., "Loop Raising of Nylon Tricot", Reprint from Journal of the Textile Machinery Society of Japan, vol. 33, No. 3 (Mar., 1980).

*Primary Examiner*—Werner H. Schroeder
*Assistant Examiner*—John J. Calvert
*Attorney, Agent, or Firm*—Shefte, Pinckney & Sawyer

[57] ABSTRACT

A textile napping machine is equipped with pivotable arms for supporting its napping cylinder for selective movement between an operative position wherein the cylinder is arranged in driven relationship with the machine's cylinder drive system and an inoperative position wherein the cylinder is moved to one side of the machine for easy demounting and replacement. A traveling cart docks with the machine at the inoperative position for lateral transfer of a napping cylinder between the cart and the cylinder support arms. The various operating components of the machine are microprocessor-controlled for easy programmed adjustment. The machine may be of a reduced scale in comparison to conventional production machines for experimental, research-and-development, and laboratory usage.

30 Claims, 12 Drawing Sheets

TEXTILE NAPPING MACHINE

BACKGROUND OF THE INVENTION

Napping of a textile fabric is a well known technique for enhancing the aesthetic and performance characteristics of the fabric by raising the fabric surface to provide, among other things, a softer hand, improved drapeability, greater fabric thickness, and better durability. Various types of fabric are suitable for napping, in particular warp knitted fabrics wherein the underlaps formed at the technical back of the fabric are especially susceptible to being raised from the fabric surface.

Machinery for performing napping operations basically utilizes a rotatably driven cylinder having peripheral wire teeth, normally in the nature of card clothing, over which fabric to be napped travels in a tensioned condition. In the majority of conventional napping machines, the napping cylinder is of a so-called planetary type having a plurality of napping rollers covered with card clothing supported in spaced axially parallel relationship by planetary gear sets at opposite ends of the napping rollers, whereby the rollers form the outer circumferential periphery of the napping cylinder. The cylinder is driven to rotate in the same direction as the path of travel of the fabric being napped, while the planetary gear sets are operated to drive the napping rollers to rotate in opposition to the direction of cylinder rotation and fabric travel.

The napping rollers utilized in planetary-type napping cylinders may be of several differing constructions. Napping cylinders of the so-called double acting type have alternating napping rollers equipped with card teeth extending in the same direction as cylinder rotation, commonly referred to as pile rollers, and intermediate napping rollers equipped with card teeth extending in the opposite direction, commonly referred to as counter-pile rollers. In napping cylinders of the so-called single acting type, all of the napping rollers have card wire teeth which extend in the direction of cylinder rotation and fabric travel, i.e., only pile rollers. Knit goods action napping cylinders are equipped with alternating pile rollers and intervening rollers having straight card wire teeth which are neither inclined in the direction of fabric travel or counter thereto.

The napping effect achieved in any given napping machine is dependent on the type of napping cylinder employed, the speed at which the napping cylinder is operated with respect to the traveling speed of the fabric, the speed at which the napping rollers are driven in relation to the rotational speed of the napping cylinder, and a variety of other factors. With any type of napping cylinder, positive napping energy is achieved, i.e., the wire teeth of the napping rollers penetrate the fabric surface to achieve a raising effect, only when the napping rollers are driven at a greater peripheral speed than the peripheral speed of the overall napping cylinder, the amount of napping energy being related to the difference in their surface speeds. A double acting napping cylinder operated with positive napping energy produces a uniform non-directional pile surface on fabric being napped, while single acting napping cylinders operated with positive napping energy produce a pile surface having a characteristic unidirectional lay of the raised pile. Knit goods action napping cylinders achieve a napping effect similar to that of double acting napping cylinders and are primarily utilized for processing fleecy fabrics as a preliminary step to subsequent processing on other napping machines. In contrast, by driving the napping rollers of a napping cylinder at a lesser peripheral speed than that of the overall napping cylinder, i.e., with a negative napping energy, the wire teeth of the napping rollers act in a pushing rather than raising manner on the fabric surface to produce a so-called felting action.

In addition to the foregoing factors, the napping effect achieved by any given napping machine will vary from one fabric to another based on the type of fabric construction, the type of yarn utilized, the yarn count, yarn twist and like factors. The processes to which a fabric is subjected in advance of napping, particularly wet processing of the fabric, may also affect the napping operation. Furthermore, the napping effect will additionally vary without any change in the napping machine or the fabric being napped as a result of progressive wearing of the napping teeth over the course of machine operation.

Because of the interplay of all such variables, it is difficult if not impossible to predict the napping effect of any given napping machine on a given fabric. Accordingly, the operation of conventional napping machinery is widely viewed to be as much if not more of an art than a science, resting largely in the skill and experience of the machine operator. In conventional napping machinery, considerable time is required to change napping cylinders and further time is required of the machine operator to adjust the machine settings to obtain a desired napping effect. As a result, it is not economical to change the set-up of a napping machine very often and it is even more impractical to experiment to any significant degree with differing napping effects produced by differing napping cylinders operated at differing machine settings on differing fabrics.

SUMMARY OF THE INVENTION

Accordingly, it is an object of the present invention to provide a napping machine which is capable of quick and easy exchange of napping cylinders and simple variation of machine operating parameters.

Basically, the present invention may be adapted to substantially any textile napping machine of the type having a napping cylinder with a fabric raising surface at its periphery for engagement with a traveling textile fabric and a drive arrangement for rotating the napping cylinder. According to the present invention, a support arrangement is provided for the napping cylinder by which it may be selectively moved between an inoperative position wherein the napping cylinder may be mounted and demounted to and from the supporting arrangement and an operative position wherein the napping cylinder is arranged in driven relationship with the drive arrangement for rotative engagement with a traveling textile fabric. In the preferred embodiment, the cylinder supporting arrangement comprises a pivoting arm structure for rotatably supporting the cylinder for pivotable movement between the operative and inoperative positions. Preferably, the drive arrangement utilizes a driving gear mounted at a stationary rotational axis and the napping cylinder includes a driven gear for meshing engagement with the driving gear at the operative position of the napping cylinder.

A suitable detecting arrangement is provided for recognizing whether the napping cylinder is disposed in proper driven relationship with the drive arrangement at the operative position and for disabling the drive arrangement when the napping cylinder is out of proper driven relationship with the drive arrangement. In the preferred embodiment, the detecting arrangement utilizes a feeler device, e.g., a selectively extensible plunger, mounted at a stationary disposition adjacent the operative position of the napping cylinder and the cylinder supporting arrangement is provided with a mating opening disposed for receiving the plunger substantially only when the cylinder supporting arrangement is at the operative position. The feeler and the drive arrangement are operatively associated for disabling the drive arrangement when the plunger is retracted from the mating opening and for enabling the drive arrangement when the plunger is extended into the opening.

According to another aspect of the present invention, a traveling cart is provided for transporting the napping cylinder to and from the napping machine for mounting and demounting of the napping cylinder. The cart and the napping machine have mating engagement members for docking of the cart with the napping machine adjacent the inoperative position to dispose the cart for lateral transfer of the napping cylinder between the cart and the cylinder support arrangement. Preferably, the cart has slide surfaces for alignment with cylinder support surfaces of the cylinder supporting arrangement in the inoperative position for sliding movement of the napping cylinder into and out of mounted disposition on the cylinder supporting arrangement.

The napping cylinder is provided with indicia representing characteristics of the napping cylinder, e.g., for identifying the type of napping cylinder, and the napping machine is provided with an arrangement for detecting the indicia to distinguish interchangeable napping cylinders from one another. In the preferred embodiment, the napping cylinder is provided with an identifying coaxial disk mounted for integral rotation with the napping cylinder with the indicia being arranged at the periphery of the disk, and the detecting arrangement is mounted in a fixed disposition adjacent the operative position of the napping cylinder for detecting the indicia during rotation of the napping cylinder. The napping machine is further provided with a control system which is operative following mounting of the napping cylinder to rotate the cylinder at least one full revolution to enable the detecting arrangement to identify the napping cylinder by its indicia.

The napping machine has a plurality of guide rolls for training a fabric to travel to and from peripheral contact with the napping cylinder. According to one feature of the present invention, the guide rolls are arranged for feeding the fabric to, and withdrawing the fabric from, the napping cylinder at the same side of the cylinder in its operative position. The guide rolls include a first dancer roll biased into contact with the fabric in advance of the napping cylinder for movement toward and away from the fabric in response to upstream fabric tension fluctuations and a second dancer roll biased into contact with the fabric following the napping cylinder for movement toward and away from the fabric in response to downstream fabric tension fluctuations. The guide rolls further include a driven feed roll in advance of the napping cylinder and a driven take-up roll following the napping cylinder.

A detecting arrangement is provided for detecting movements of the dancer rolls to recognize tension fluctuations in the fabric and a control arrangement is operative to adjust the driven speed of one of the driven feed and take-up rolls in response to the detecting arrangement. In an embodiment of the present invention in a napping machine having a napping cylinder of the type having a planetary arrangement of driven napping rollers, the control arrangement is preferably operative for varying the driven speed of the napping rollers in response to detected movements of the first dancer roll and for varying the driven speed of the take-up roll in response to detected movements of the second dancer roll.

The control arrangement is also preferably operative in a thread-up move for moving the dancer rolls away from the path of fabric travel and for operating the feed roll, the napping cylinder and the take-up roll at relatively slow respective driven speeds, without rotation of the napping rolls relative to the napping cylinder, to facilitate thread-up of a fabric to be napped.

It is also preferred that each dancer roll be provided with an associated shock absorber arrangement for dampening movements of the roll. A braking arrangement may also be provided to operate upon a stoppage of the napping machine to maintain the then-prevailing disposition of the dancer rolls.

The napping machine is further preferably provided with a suitable detecting arrangement adjacent the path of fabric travel in advance of the napping cylinder to detect a seam joining two ends of fabric to be napped. For example, the detecting arrangement may include a metal detector to recognize a metallic element at the fabric seam such as a seaming thread having a metallic strand component.

According to another aspect of the present invention, the napping machine is provided with an arrangement for selectively grinding fabric engaging teeth which form the fabric raising surface of the napping cylinder, without requiring removal of the napping cylinder from the napping machine. Preferably, the grinding arrangement includes a grinding member selectively movable radially toward and away from the napping cylinder into and out of grinding engagement with its fabric engaging teeth and axially along the napping cylinder for grinding engagement with such teeth along the full axial extent of the cylinder. In one preferred embodiment, the grinding member may include a plurality of driven grinding disks mounted for selective adjustment of their orientation with respect to the teeth of the napping cylinder.

The present invention also contemplates a novel napping cylinder of the type having a planetary arrangement of driven fabric engaging rollers, wherein at least one of the rollers is equipped with fabric engaging teeth, e.g., card clothing, and at least another one of the rollers is equipped with a fabric abrading surface, e.g., sueding sandpaper.

In a preferred embodiment of the present invention, the textile napping machine is of a relatively narrow width and relatively reduced scale in comparison to conventional commercial napping machines so as to be adapted for use for laboratory testing and other experimental napping operations.

DESCRIPTION OF THE PREFERRED EMBODIMENT

The present invention is herein described and illustrated as preferably embodied in a napping machine of a substantially reduced scale in comparison to conventional commercial production napping machines to be adapted for use in research and development laboratories for varied purposes such as performing experimental and comparative napping operations using differing types of napping cylinders on differing types of fabric at differing machine settings and operational parameters, producing sample yardage of differing styles of napped fabrics, and other uses and purposes for which conventional production size napping machines are unsuited and impractical. However, it will be readily recognized by those persons skilled in the art that the numerous novel aspects of the present invention are equally well adapted for incorporation and use in full-scale commercial production napping machines and, accordingly, the present invention is not limited in scope and application to the particular preferred embodiment herein described and illustrated.

With reference now to the accompanying drawings and initially to FIGS. 1-7, the napping machine of the present invention is broadly indicated generally at 20 and basically includes a floor-standing frame 22 having laterally spaced upright main side walls 24, 26 located at the opposite left and right sides of the frame 22, between which side walls 24, 26 are rotatably supported a main napping cylinder 28 at the forward side of the frame 22 and two sets of guide rollers, generally indicated at 25 and 27, respectively, (FIGS. 2 and 5-7) at the rearward side of the frame 22 laterally adjacent the upper and lower sides of the main napping cylinder 28 for training a textile fabric to travel to and from peripheral contact with the napping cylinder 28 to be napped thereby.

Figure 7:
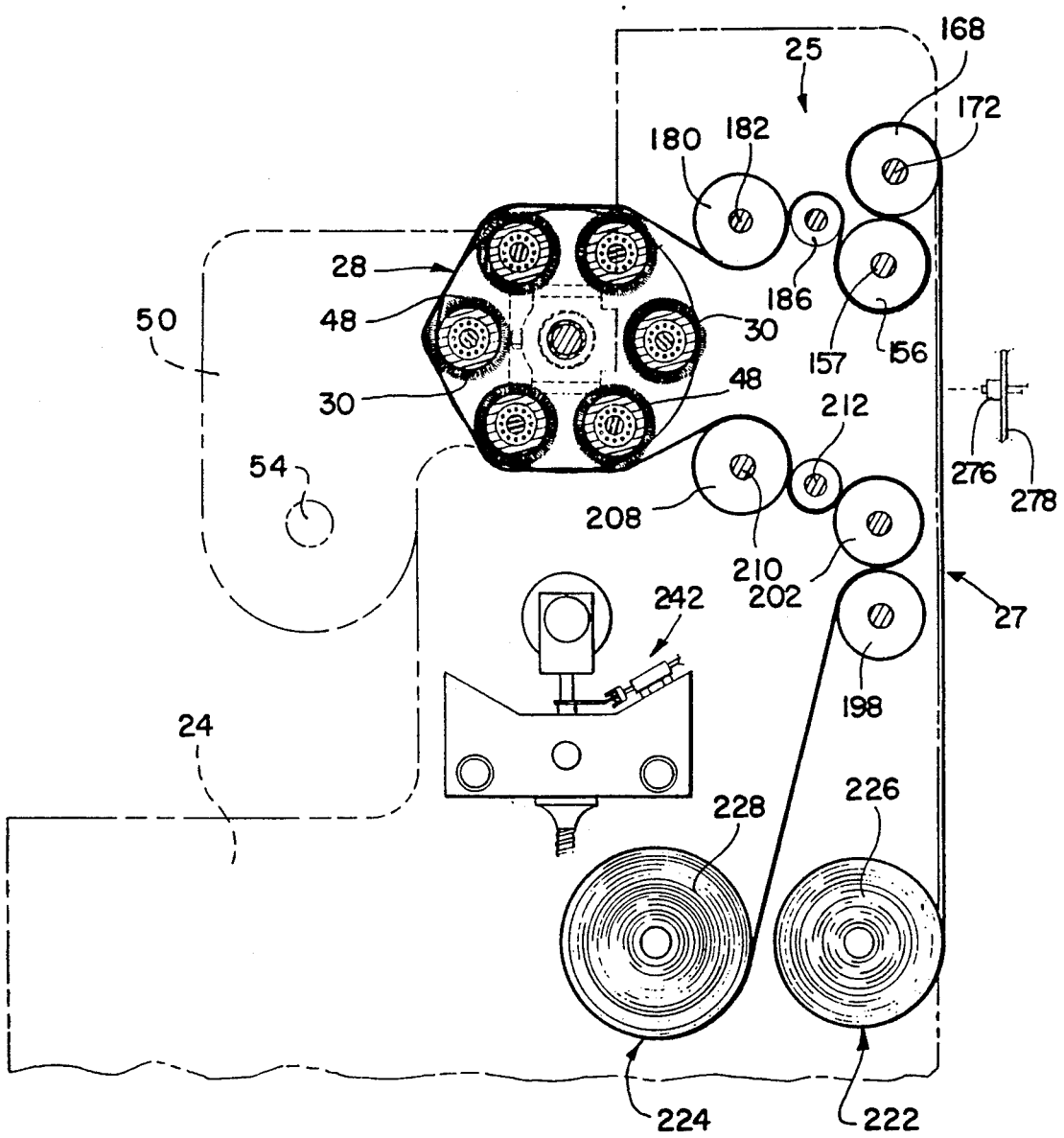
FIG. 7 is another vertical cross-sectional view of the napping machine of FIG. 1 taken along line 7—7 thereof.
Figure 8:
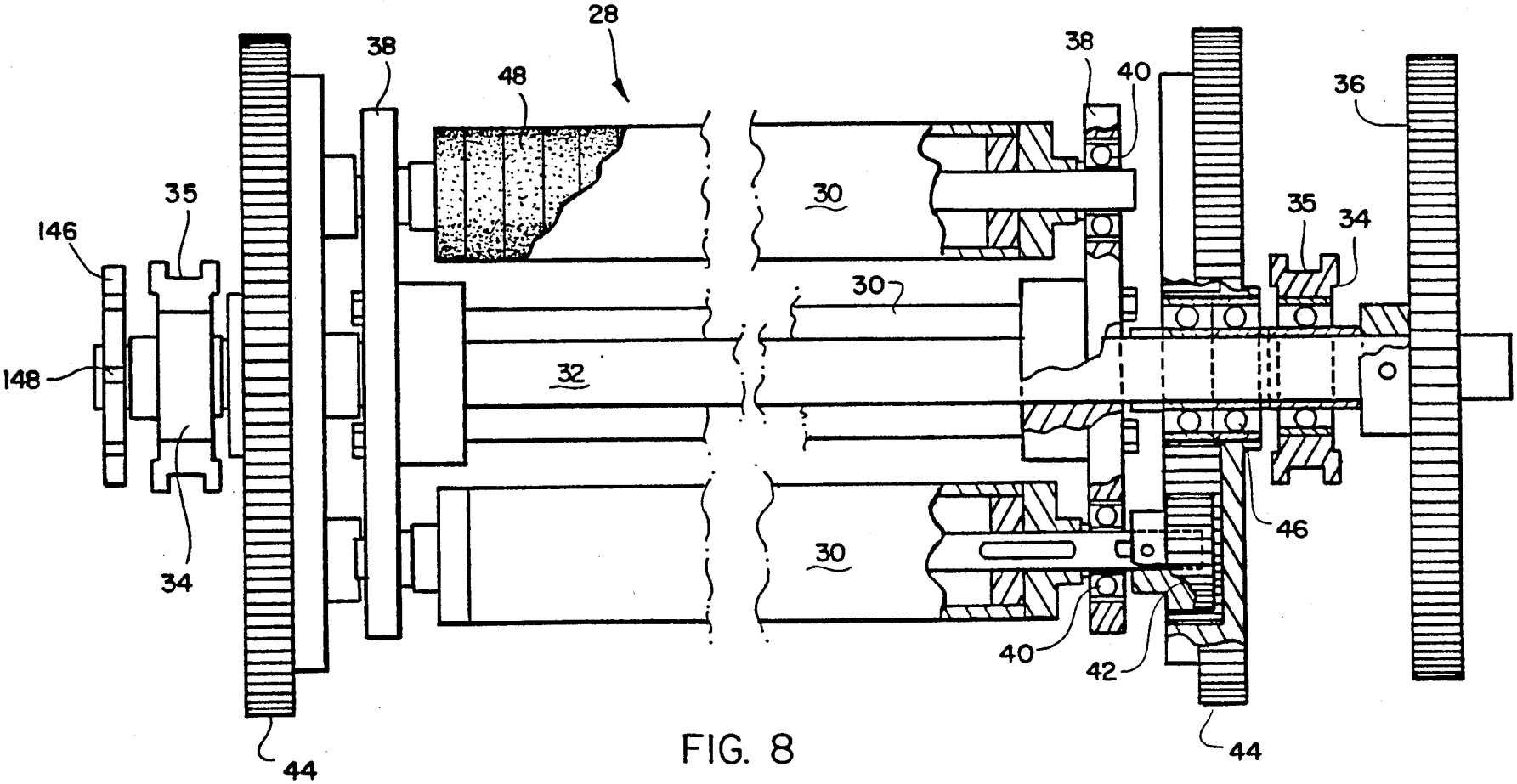
FIG. 8 is a view, partially in elevation and partially in longitudinal cross-section, of the main napping cylinder of the napping machine of FIG. 1.

As shown in FIGS. 7 and 8, the main napping cylinder 28 is generally of the conventional type having a planetary arrangement of multiple napping rollers 30 in spaced circumferential arrangement about the periphery of the napping cylinder 28 thereby to form collectively its peripheral fabric raising surface. The main napping cylinder 28 has a central shaft 32 extending the length of the cylinder 28 with a pair of shaft support bearings 34 affixed rigidly to the shaft 32 adjacent its opposite ends for rotatably mounting the shaft 32 to the side walls 24, 26 of the machine frame 22 and a main cylinder drive gear 36 rigidly affixed to the rightward end of the shaft 32 outwardly adjacent the rightward support bearing 34 for driving rotation of the shaft 32. A pair of annular ring gears 44, each having gear teeth about both its outer and inner circumference, are respectively supported rotatably on the shaft 32 by bearings 46 inwardly adjacent the shaft support bearings 34. A pair of roller support plates 38 are rigidly affixed to the shaft 32 inwardly adjacent the ring gears 44 and support therebetween the opposite ends of the napping rollers 30 by bearings 40 affixed to the support plates 38 at circumferential spacings thereabout. Each of the napping rollers 30 has a stub shaft projecting from one end outwardly beyond the support plate 38 by which it is supported, to which stub shaft is rigidly affixed a planet gear 42 in meshing engagement with the internal teeth of one of the ring gears 44. For compactness, alternate ones of the rollers 30 are mounted to the support plates 38 with their stub shafts and planet gears 42 at the rightward end of the napping cylinder 28 for meshing engagement with the rightward ring gear 44, while the intermediate ones of the napping rollers 30 are oppositely mounted to the support plates 38 with their stub shafts and planet gears 42 at the leftward end of the napping cylinder 28 for meshing engagement with the leftward ring gear 44. In this manner, overall rotation of the main napping cylinder 28 may be driven through the main cylinder drive gear 36 to move the napping rollers 30 in an orbital path about the shaft 32, while the alternating and intermediate sets of the napping rollers 30 may be independently rotated from their respectively associated ring gears 44.

Figure 13:
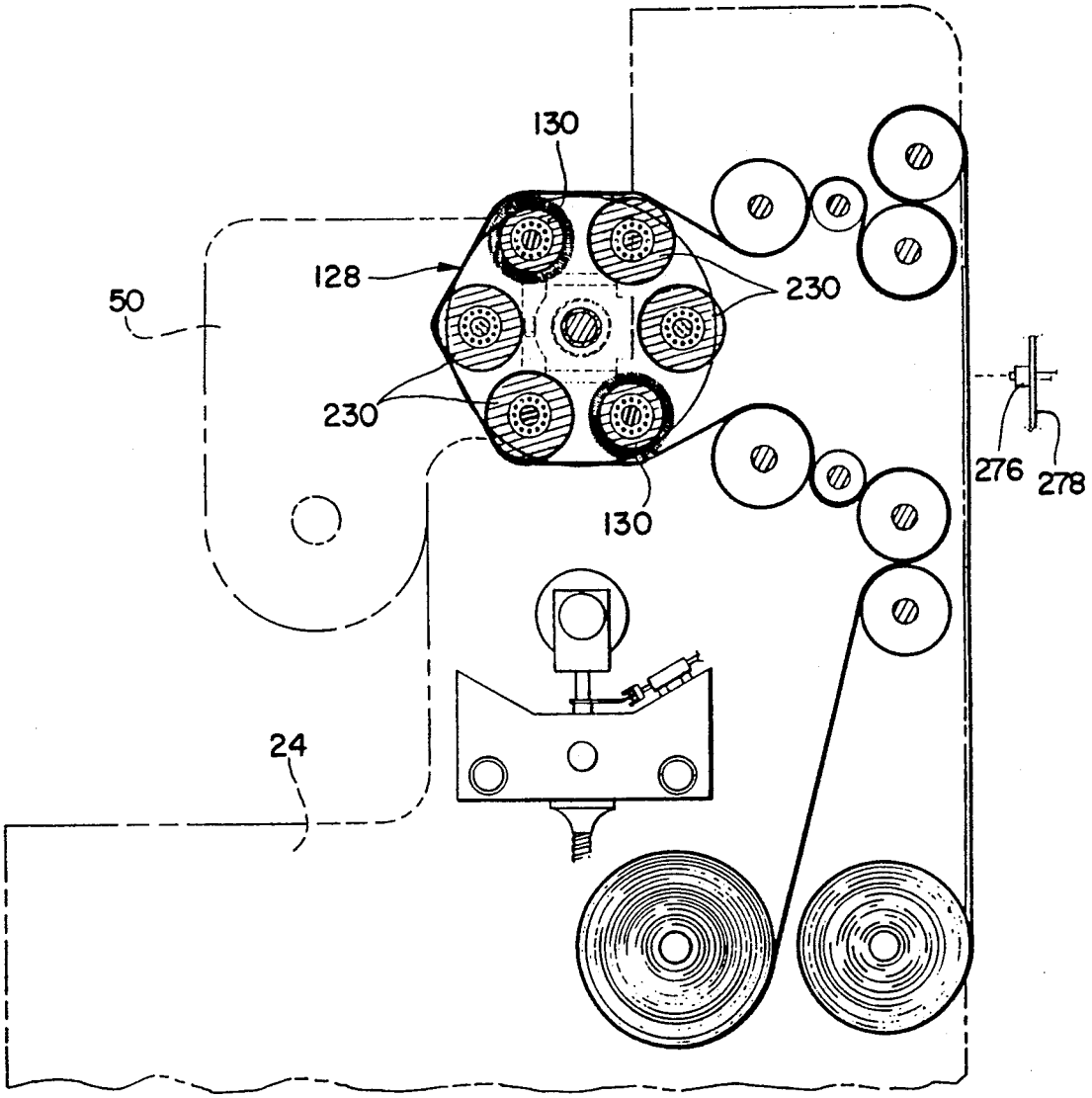
FIG. 13 is a vertical cross-sectional view taken diametrically through an alternative main napping cylinder for use in the napping machine of FIG. 1.

In conventional manner, each of the napping rollers 30 is covered by card clothing affixed in a helical fashion about substantially the full axial and circumferential extent of each roller to present projecting wire teeth 48 at the periphery of each roller 30 for napping engagement with a textile fabric. As illustrated in FIG. 7, the wire teeth 48 of alternate and intermediate ones of the napping rollers 30 project in opposite directions, whereby the napping cylinder 28 is of the double-acting type. Of course, it will be readily recognized by those persons skilled in the art that the napping rollers 30 of the napping cylinder 28 could be arranged equally well with the wire teeth of each roller 30 projecting in the same direction for functioning of the napping cylinder 28 in a single-acting fashion, or alternatively the napping cylinder 28 may be of any other napping construction, now or hereafter known. For example, FIG. 13 illustrates a novel alternative form of napping cylinder 128 wherein a diametrically opposed pair of napping rollers 130 are covered with conventional card clothing while the remaining rollers 230 have an abrasive covering such as sueding sandpaper for producing a brushing or sueding effect on a textile fabric. The central structural core of the abrasive rollers 230 is of a sufficiently larger diameter than that of the card clothed rollers 130 to form each of the rollers 130, 230 of the same overall outer diameter.

Figure 3:
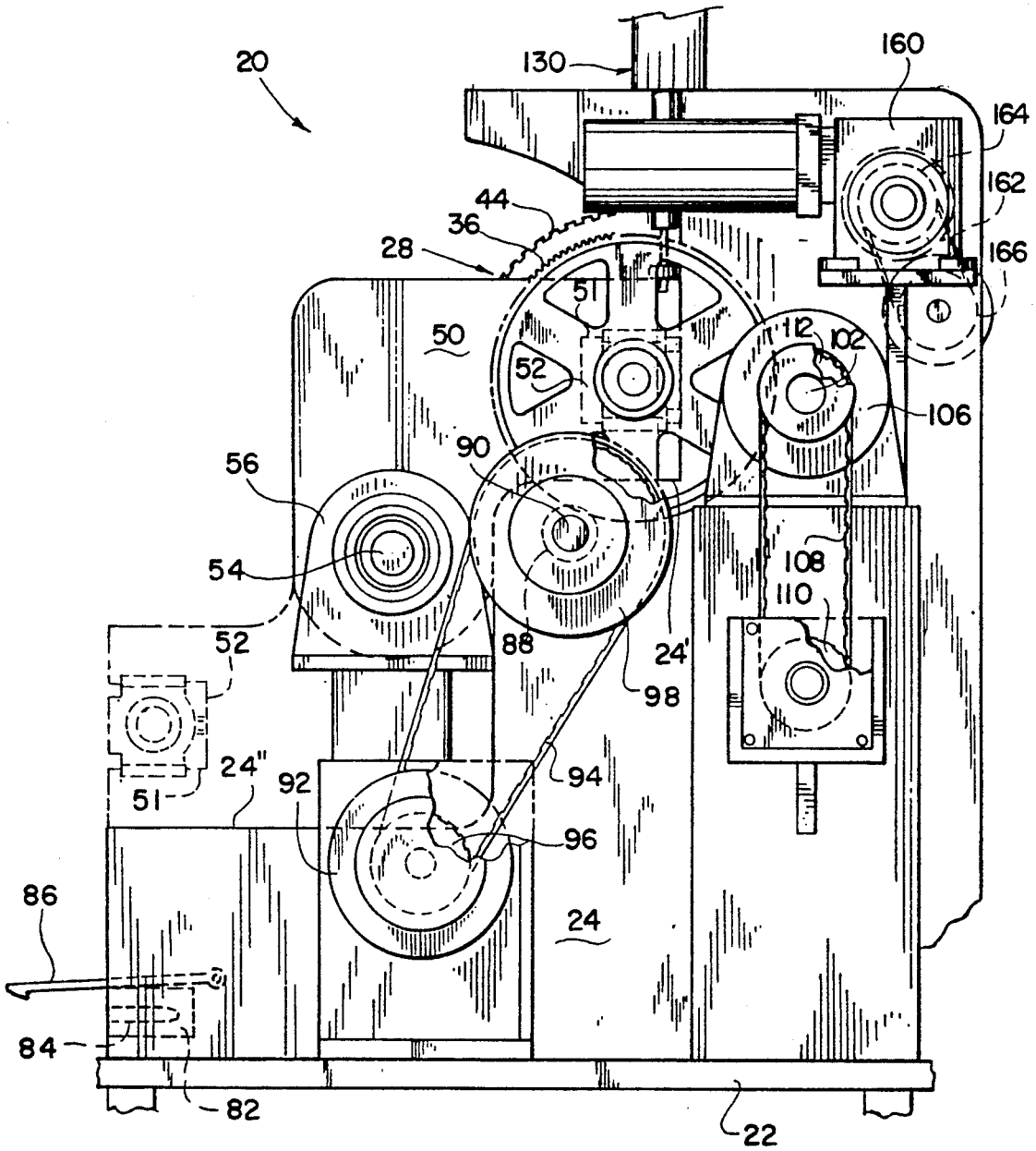
FIG. 3 is a left side elevational view of the napping machine of FIG. 1.
Figure 4:
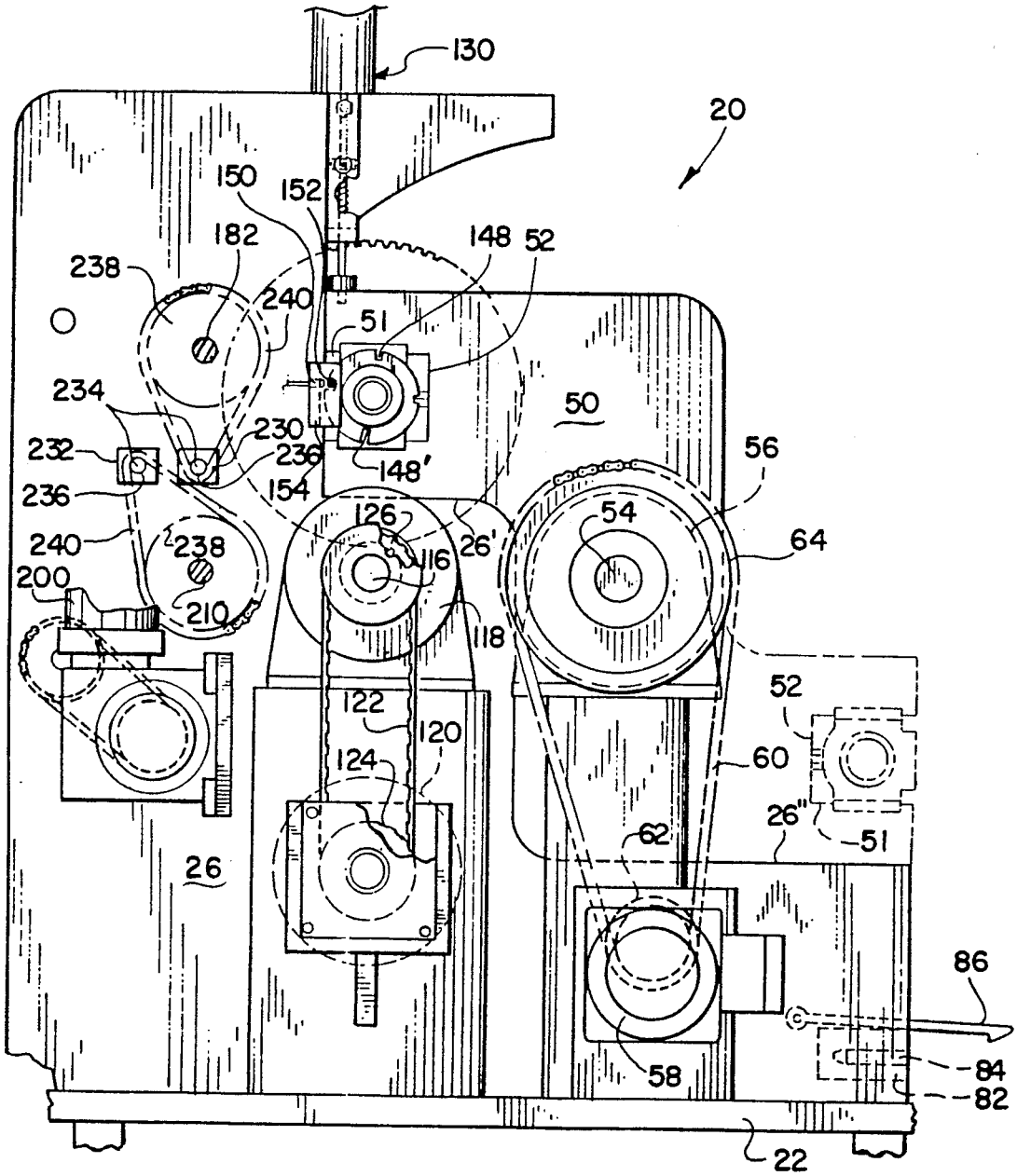
FIG. 4 is a right side elevational view of the napping machine of FIG. 1.
Figure 5:
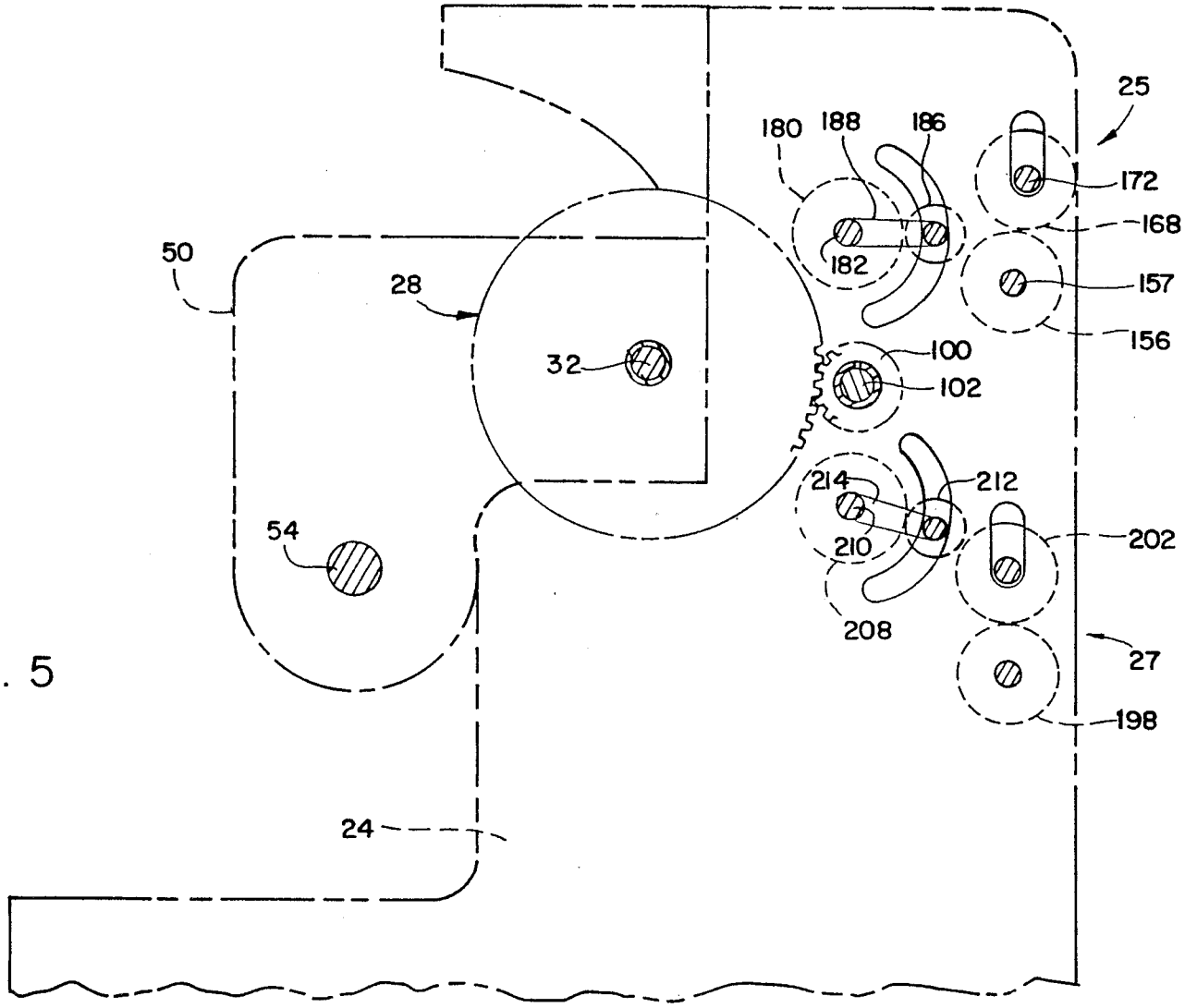
FIG. 5 is a vertical cross-sectional view of the napping machine of FIG. 1 taken along line 5—5 thereof.
Figure 6:
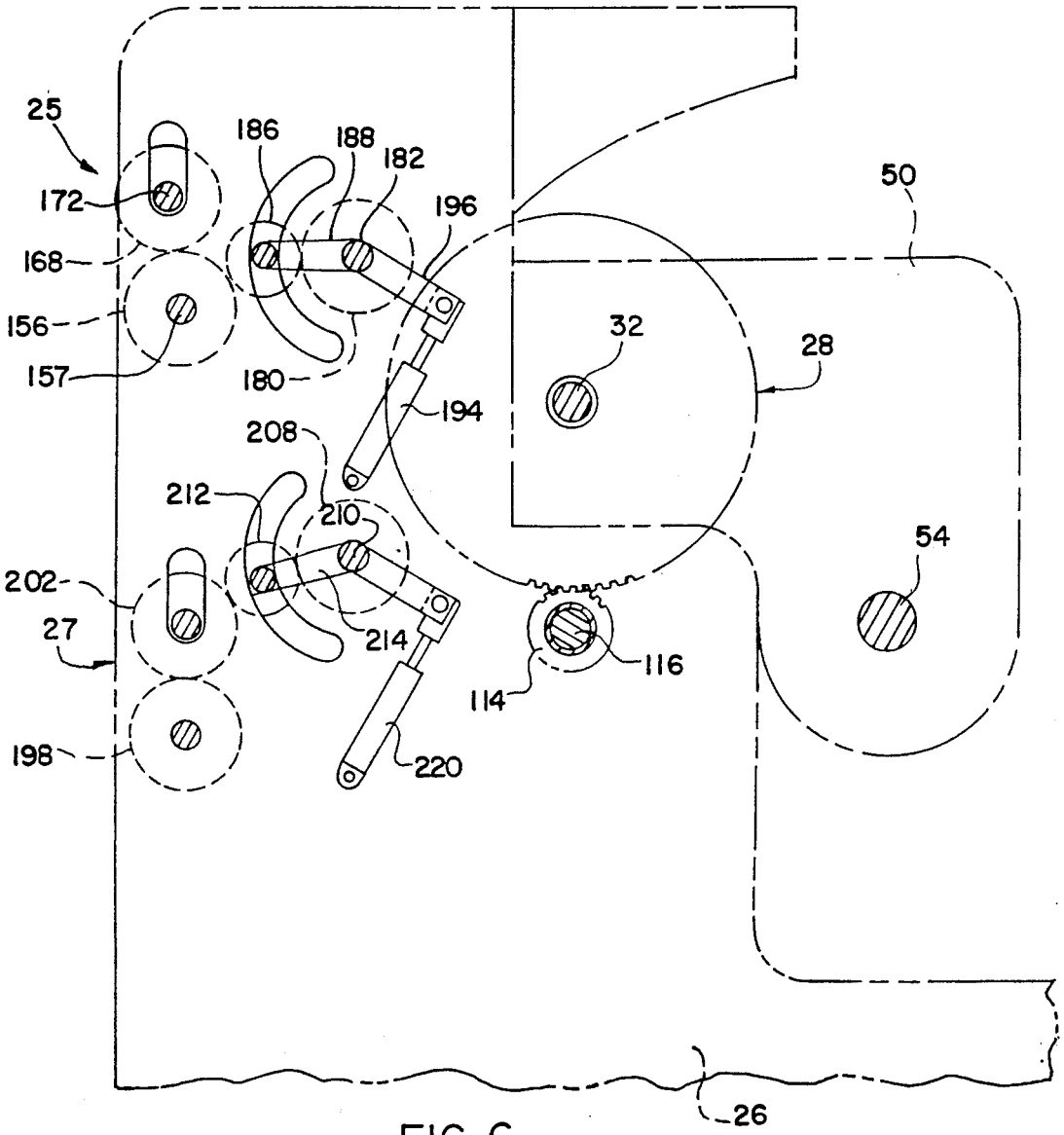
FIG. 6 is another vertical cross-sectional view of the napping machine of FIG. 1 taken along line 6—6 thereof.

Referring now to FIGS. 3 and 4, each of the main side walls 24, 26 of the napping machine frame 22 includes an L-shaped cylinder support arm 50 having a rectangular recess 52 at one end for receiving a respective one of the main support bearings 34 on the shaft 32 of the napping cylinder 28 by sliding engagement of the lateral surfaces 51 of the support arm 50 in mating channels 35 at opposite sides of the bearing 34. The opposite end of each cylinder support arm 50 is rigidly affixed to a pivot shaft 54 rotatably supported by bearings 56 mounted to the frame 22 for pivotal movement of the cylinder support arms 50 between an operative position shown in full lines in FIGS. 3 and 4, wherein the support arms 50 rest in abutment on surfaces 24', 26' of the main frame side walls 24, 26 to dispose the napping cylinder 28 for normal napping operation, and an inoperative position shown in broken lines in FIGS. 3 and 4, wherein the cylinder support arms 50 rest in abutment on surfaces 24'', 26'' disposing the napping cylinder 28 at the forwardmost extent of the frame 22 to facilitate mounting and demounting of the napping cylinder 28 to and from the support arms 50. As will be seen, in the operative position, the mounting recesses 52 of the cylinder support arms 50 are completely enclosed by the main side walls 24, 26 of the machine frame 22 to securely maintain the napping cylinder 28 in its mounted disposition on the support arms 50, while in the inoperative position the mounting recesses 52 open horizontally forwardly from the machine frame 22 to permit the cylinder support bearings 34 to slide horizontally along the sliding surfaces 51 of the cylinder support arms 50 for mounting and demounting of the napping cylinder 28. Pivotal movement of the cylinder support arms 50 is actuated by a drive motor 58 mounted at the leftward side of the frame 22 (FIG. 4) and connected in driving relationship to the pivot shaft 54 through a drive chain 60 trained about a driving sprocket 62 on the drive shaft of the motor 58 and a driven sprocket 64 affixed to the leftward end of the pivot shaft 54.

Figure 10:
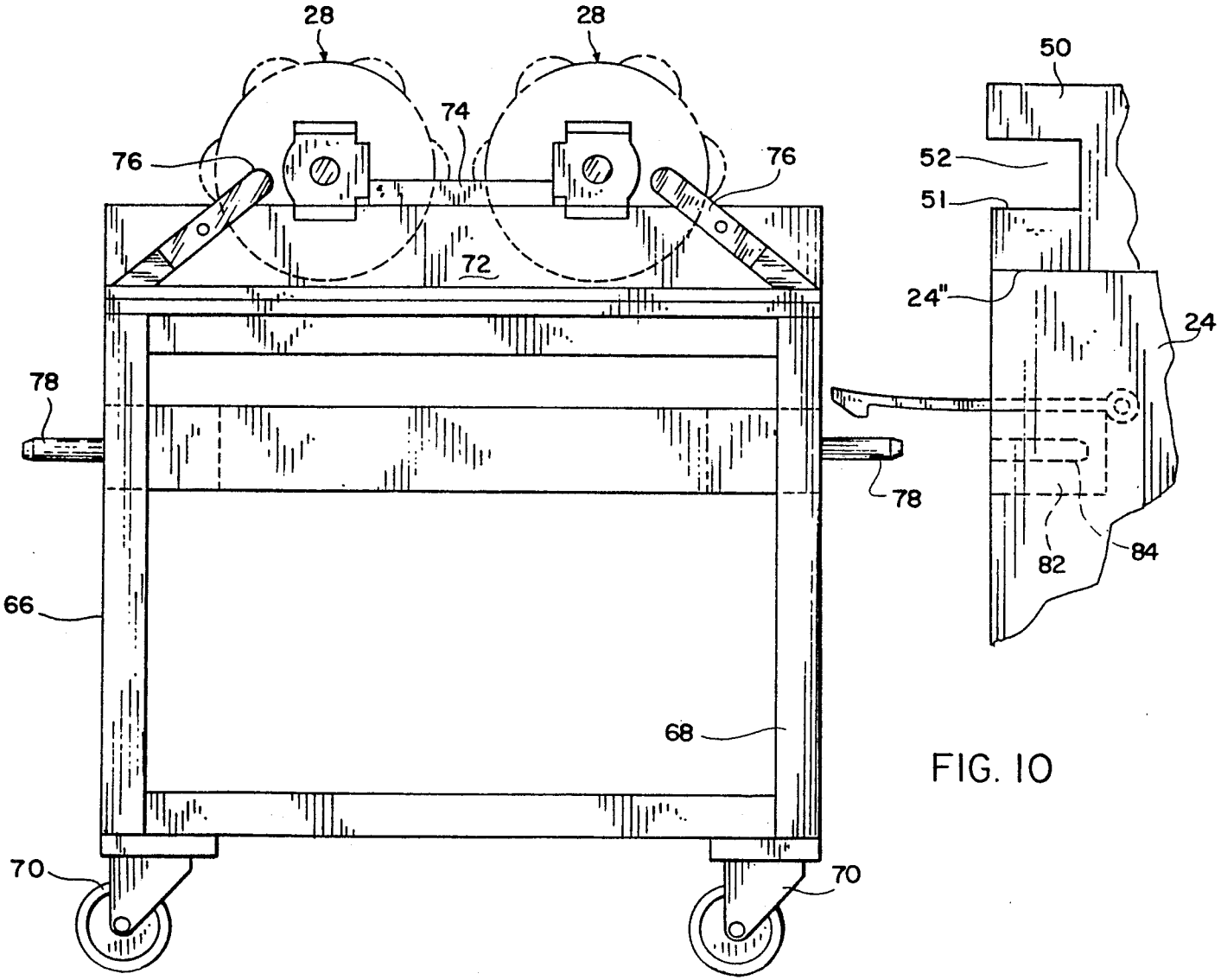
FIG. 10 is a side elevational view of a traveling cart according to the present invention for transporting interchangeable replacement main cylinders to and from the napping machine of FIG. 1.
Figure 11:
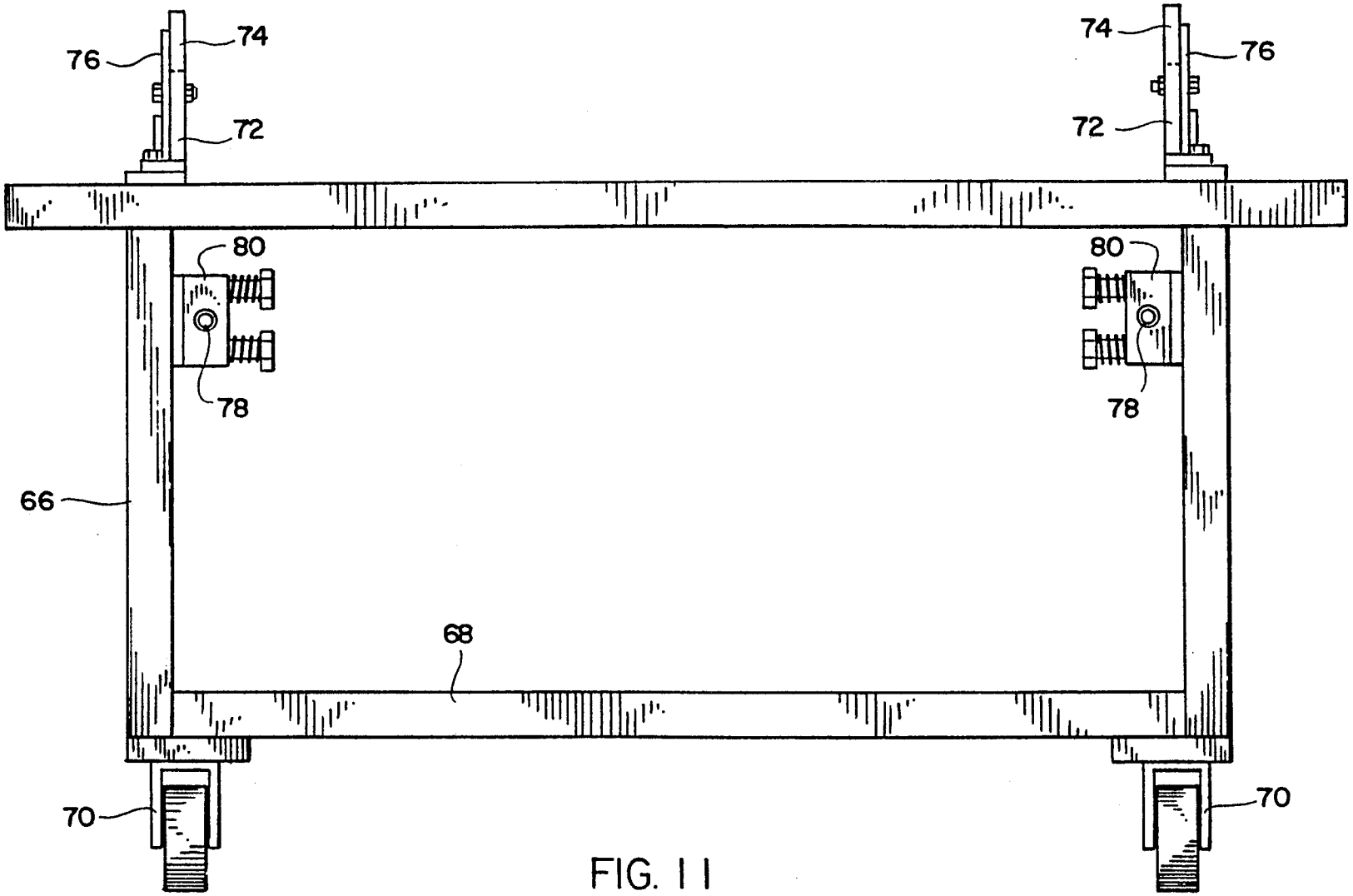
FIG. 11 is a front elevational view of the cart of FIG. 10.

To further facilitate quick and easy mounting and demounting of the napping cylinder 28 to and from the cylinder support arms 50, and in particular to facilitate easy interchangeability of one napping cylinder 28 for another, the present invention provides a traveling cart 66 for transporting napping cylinders 28 to and from the napping machine 20, as best seen in FIGS. 10 and 11. The cart 66 has a main frame 68 supported on a plurality of casters 70 for easy rolling movement from one location to another. A pair of support flanges 72 are mounted to the top of the frame 68 at opposite sides thereof at a spacing from one another identical to that of the support bearings 34 on the napping cylinder 28 so that a napping cylinder 28 may be slidably supported by the channel portions 35 of its support bearings 34 on the flanges 72. A stop bar 74 is mounted centrally along the length of each support flange 72 to prevent a pair of napping cylinders 28 supported on the flanges 72 from possibly damaging contact with one another. Similarly, stop arms 76 are pivotably affixed at the opposite ends of one or both support flanges 72 for selective movement into and out of disposition to act as a stop against sliding movement of the cylinder support bearings 34 outwardly along the flanges 72.

As shown in FIG. 10, the cart is of a height such that the upper sliding surfaces of the support flanges 72 are at substantially the identical elevation as the lowermost sliding surfaces 51 of the cylinder support arms 50 when in the inoperative position and the pivotable arrangement of the cylinder support arms 50 orients them sufficiently forwardly with respect to the napping machine frame in their inoperative position to enable the cart 66 to be maneuvered into abutment of the flanges 72 with the cylinder support arms 50 to substantially align their respective sliding surfaces for sliding transfer of a napping cylinder 28 between the cylinder support arms 50 of the napping machine 20 and the flanges 72 of the cart 66.

To assist in positioning of the cart 66 for cylinder transferral in this manner, the cart frame 68 is provided at both its forward and rearward sides with a pair of laterally spaced locating studs 78 affixed to mounting blocks 80, and the forward side of the napping machine frame 22 is provided with a laterally spaced pair of receiving blocks 82 respectively formed with bores 84 for receiving the locating studs 78 and with hooked levers 86 for latching engagement with the mounting blocks 80. The mounting and receiving blocks 80, 82 are respectively located on the cart frame 68 and the machine frame 22 to precisely position the flanges 72 in alignment with the lower sliding surfaces 51 of the cylinder support arms 50 when the locating studs 78 are received in the bores 84. Thus, with the aid of the latching levers 86, the cart 66 may be securely docked with the napping machine 20 for easy transferral of a napping cylinder 28 therebetween.

To interchange one napping cylinder for another, the replacement napping cylinder 28 is mounted on the flanges 72 at one side of the cart 66 while leaving the cylinder support location at the opposite side of the cart unoccupied. After pivotal movement of the cylinder support arms 50 into the inoperative position, the unoccupied side of the cart 66 is docked with the napping machine 20 for transferral of the napping cylinder 28 from the cylinder support arms 50 to the unoccupied support location on the flanges 72 of the cart 66, after which the cart 66 is turned to dock its opposite side with the napping machine 20 for transferral of the replacement napping cylinder 28 to the unoccupied cylinder support arms 50.

For driving operation of the napping cylinder 28 in its operative position, a drive shaft 90 is rotatably journaled to the right side wall 24 of the napping machine frame 22 beneath the location occupied by the main cylinder drive gear 36 in the operative position of the napping cylinder 28 and carries a driving gear 88 outwardly adjacent the side wall 24 for meshing engagement with the drive gear 36 in the operative position of the napping cylinder 28, as shown in FIG. 3. The drive shaft 90 is driven from a variable speed electric drive motor 92 through a timing belt 94 trained about a drive sprocket 96 affixed to the drive motor shaft and a drive sprocket 98 affixed to the drive shaft 90 outwardly adjacent the driving gear 88.

Similarly, to drive rotation of the napping rollers 30 in the operative position of the napping cylinder 28, a drive gear 100 is supported inwardly adjacent the right side wall 24 on a drive shaft 102 rotatably journaled in the side wall 24 adjacent the location occupied by the rightward ring gear 44 in the operative disposition of the napping cylinder 28 for meshing engagement of the drive gear 100 with the right ring gear 44 when the napping cylinder 28 is in its operative position. (See FIG. 5). The outward end of the drive shaft 102 is connected to a speed change gear box 106 which is driven by a variable speed electric drive motor 104 through a timing belt 108 trained about drive sprockets 110, 112 on the drive shafts of the drive motor 104 and the gear box 106. (See FIG. 3). Another drive gear 114 is mounted at the inward side of the left side wall 26 of the machine frame 22 on a drive shaft 116 rotatably journaled in the side wall 26 below the location occupied by the leftward ring gear 44 of the napping cylinder 28 in its operative position for meshing engagement of the drive gear 114 with the ring gear 44 when the napping cylinder 28 is in its operative position. (See FIG. 6). The drive shaft 116 is driven at its outward end through a speed change gear box 118 driven by a drive motor 120 through a timing belt 122 trained about drive sprockets 124, 126 on the respective shafts of the drive motor 120 and the speed change gear box 118. (See FIG. 4).

The napping machine 20 is equipped with a central control system, preferably in the form of a programmable computer, microcontroller, or other suitable microprocessor, shown only representatively at 125 in FIG. 1, for independently controlling the actuation, deactuation and operational speed of each of the motors 58, 92, 104, 120, as well as the other operational components of the napping machine 20 as hereinafter described.

As will be understood, upon any movement of the cylinder support arms 50 from the inoperative position to the operative position such as following the mounting of a new napping cylinder 28, it is possible that one or more of the main cylinder driving gear 36 and the ring gears 44 may not properly come into meshing engagement with the respective drive gear or gears 88, 100, 114 when the cylinder support arms 50 reach the operative position, e.g., due to direct tooth-to-tooth contact of the gears rather than meshing thereof, and in such case it is undesirable to actuate the respective drive motors 92, 104, 120 because possible damage could result to the respective gears, to other components of the napping cylinder 28, or to other components of the napping machine 20. Accordingly, to monitor whether the drive gear sets for the napping cylinder 28 are in complete proper meshing engagement following any pivotal actuation of the cylinder support arms 50, the edge surface of each cylinder support arm 50 which faces upwardly in the operative position is formed with a bore 128 and a feeler device 130 is mounted to each main side wall 24, 26 of the machine frame 22 in disposition for mated receipt within the bore 128 of the associated cylinder support arm 50 when in its operative position.

Figure 9:
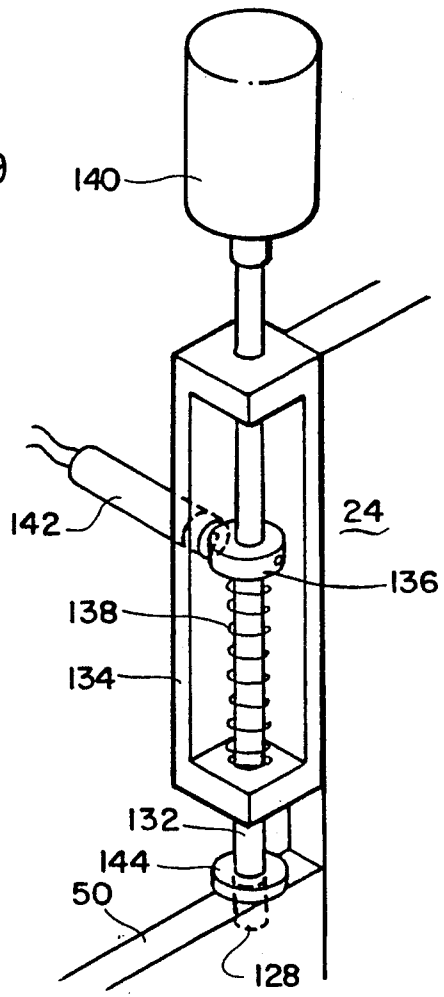
FIG. 9 is a side elevational view of the arrangement in the napping machine of FIG. 1 for detecting proper meshing engagement of the main napping cylinder with its associated drive arrangement.

As best seen in FIG. 9, the feeler device 130 is preferably in the form of a linear plunger 132 slidably supported by a bracket 134 mounted on the respective side wall 24, 26 for reciprocal vertical movement of the plunger 132 toward and away from the associated cylinder support arm 50 to move into and out of the bore 128. An enlarged collar 136 is formed at an intermediate location o the plunger 132 and a coil spring 138 extends about the plunger 132 between the collar 136 and the bracket 134 to bias the plunger 132 away from the cylinder support arm 50. The upper end of the plunger 132 is connected to a pneumatically-operated piston-and-cylinder assembly 140 for actuating downward movement of the plunger 132 into engagement with the cylinder support arm 50. When the cylinder support arms 50 are moved to the inoperative position, each of the piston-and-cylinder assemblies are deactuated, permitting the biasing force of the springs 138 to withdraw the plungers 132 from the cylinder support arms 50. When the cylinder support arms 50 are returned to the operative position, the piston-and-cylinder assemblies 140 are actuated to extend the plungers 132. A proximity sensor switch 142 is mounted to each bracket 134 adjacent the disposition assumed by the collar 136 when the plunger 132 is fully extended into the bore 128 in the associated cylinder support arm 50 in order to recognize the presence of the collar 136.

As will be understood, if however the drive gear sets for the napping cylinder 28 do not come into proper meshing engagement when the napping cylinder 28 is returned to the operative position by the cylinder support arms 50, the support arms 50 will not move fully into the operative position and, in turn, the bores 128 will not be disposed directly beneath the respective plungers 132 so that the plungers 132 will engage instead the upper edge of the cylinder support arms 50 and the collars 136 will be situated above rather than adjacent their associated proximity sensor switches 142. The proximity sensor switches 142 are operatively connected with the main control system for the napping machine 20 to disable actuation of the drive motors to the napping cylinder 28 in such event and to actuate the drive motor 58 to the cylinder support arms 50 to move the napping cylinder 28 out of, and then back into, the operative position until the drive gear sets to the napping cylinder 28 come into proper meshing engagement as recognized by the feeler device 130. Once the plungers 132 have properly engaged in the bores 128 of the cylinder support arms 50, the piston-and-cylinder assemblies 140 exert sufficient force on the cylinder support arms 5 through shoulders 144 adjacent the lower ends of the plungers 132 to hold the cylinder support arms 50 and the napping cylinder 28 in the operative position against any counter-acting force tending to move the cylinder 28 and its support arms 50 toward the inoperative position.

It will also be understood that following any actuation of the drive motor 58 to move the cylinder support arms 50 and the napping cylinder 28 out of the operative position, such as for installation of a new replacement napping cylinder 28, the central controller 125 for the napping machine 20 should be informed as to the differing characteristics of the new napping cylinder 28 since such may affect the manner of control of the various operating components of the napping machine 20. For this purpose, each napping cylinder 28 which may be utilized with the napping machine 20 is provided with an identifying disk 146 (FIGS. 4 and 8) rigidly affixed coaxially to the shaft 32 of the napping cylinder 28 at its leftward end outwardly adjacent the leftward support bearing 34. The identifying disk 146 of each differing napping cylinder 28 is provided with its own individually distinctive indicia, preferably in the form of a particular number or arrangement of peripheral slots 148 formed in the disk 146, to distinguish its napping cylinder 28 from other interchangeable napping cylinders 28 according to their differing characteristics, e.g., single acting cylinder, double acting cylinder, knitting action cylinder, etc. In addition, one of the peripheral slots 148 of each identifying disk 146 is of an elongated radial dimension to provide a reference from which the number and speed of revolutions of the associated napping cylinder 28 can be determined.

Figure 1:
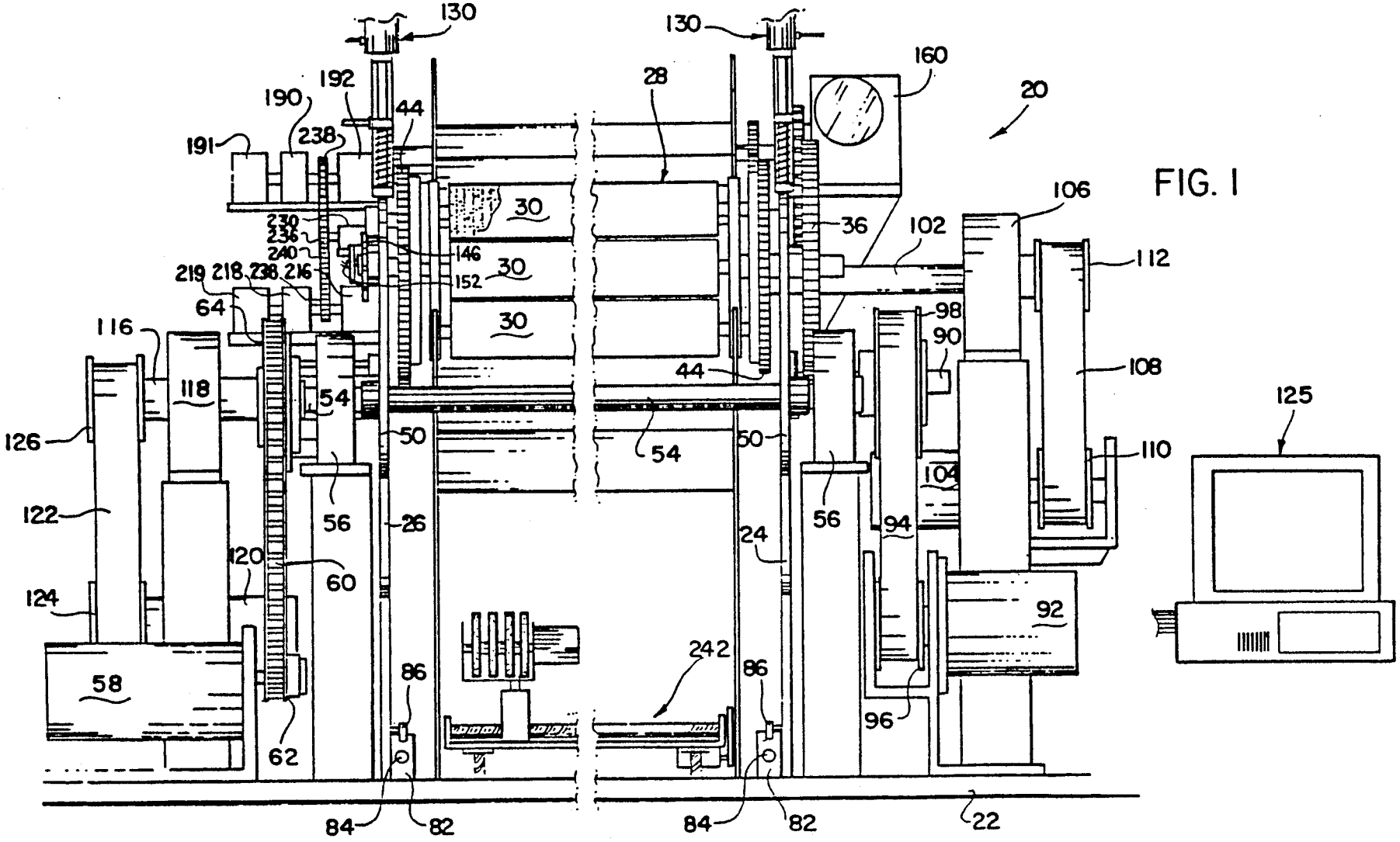
FIG. 1 is a front elevational view of a textile napping machine according to the preferred embodiment of the present invention.
Figure 2:
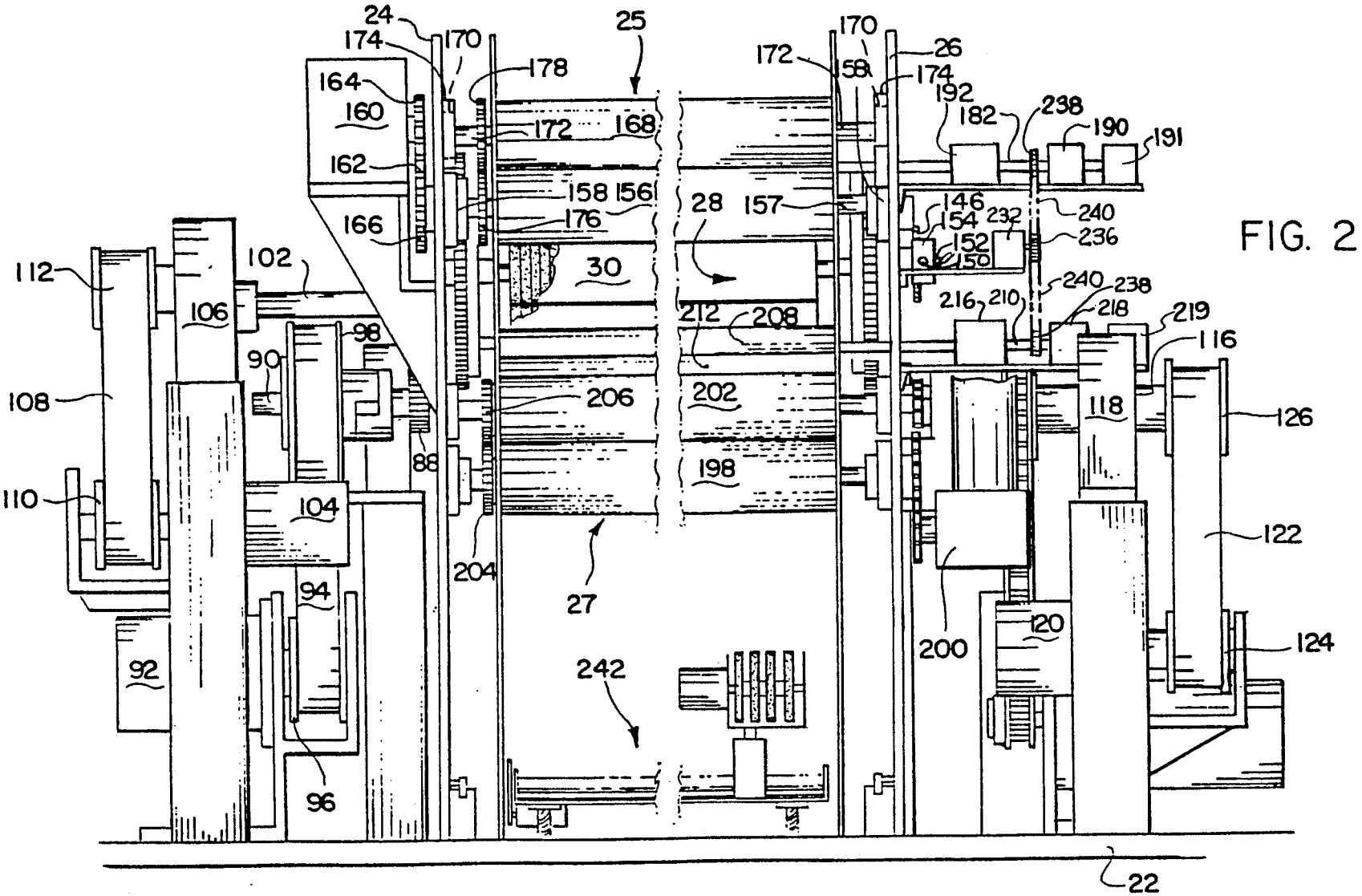
FIG. 2 is a rear elevational view of the napping machine of FIG. 1.

As seen in FIGS. 1, 2 and 4, a pair of inductive sensors 150, 152 are mounted on a bracket 154 affixed to the leftward side wall 26 of the machine frame 22 peripherally adjacent the disposition of an identifying disk 146 when its napping cylinder 28 is in the operative position, the sensor 150 being supported in coplanar relation to the disk 146 in radial orientation with respect thereto to recognize each slot 148 in the disk 146 upon rotation of the napping cylinder 28 while the other sensor 152 is supported axially with respect to the disk 146 at a sufficient spacing from its periphery to recognize only the radially elongated slot 148'. Each sensor 150, 152 is operatively connected to the main controller 125 of the napping machine 20 to transmit upon rotation of the napping cylinder 28 respective signals representing the slots 148, 148' recognized by the sensors 150, 152, from which the controller 125 can determine the identity of the particular napping cylinder 28 in operation as well as its rotational speed. The controller 125 is operative following any pivoting movement of the cylinder support arms 50 to actuate the drive motor 92 to rotate slowly the napping cylinder 28 through one complete revolution to identify the napping cylinder 28 before actuating full operation of the napping machine 20.

With reference to FIGS. 2 and 5–7, the upper set of guide rolls 25 includes a feed roll 156 rotatably mounted by a central shaft 157 journaled at its opposite ends in bearings 158 affixed to the opposite side walls 24, 26 of the machine frame 22 immediately adjacent their rearwardmost edges. The rightward end (leftward as viewed in FIG. 2) of the feed roll shaft 157 protrudes through its supporting bearing 158 and is driven by a variable speed electric motor 160 through a drive chain 162 trained about drive sprockets 164, 166 respectively affixed to the drive shaft of the motor 160 and the leftward end of the feed roll shaft 157. A pinch roll 168 is rotatably supported directly above the feed roll 156 to rest thereon in peripheral surface contact therewith by a central shaft 172 the opposite ends of which carry bearing rollers 170 received within vertical guide channels 174 affixed in facing relationship t the inward surfaces of the opposite side walls 24, 26 of the machine frame 22. Meshing drive gears 176, 178 are affixed respectively to the rightward ends of the feed and pinch rollers 156, 168, by which the pinch roller 168 is driven from the feed roller 156 in opposite direction thereto. An idler roller 180 is mounted at a forward spacing from the nip area between the feed and pinch rollers 156, 168 for free rotation about a central shaft 182 which is rotatably supported at opposite sides of the idler roller 180 in bearings (not shown) affixed to the opposite side walls 24, 26 of the frame 22. A dancer roller 186 is rotatably supported at its opposite ends by a pair of arms 188 affixed rigidly to, and extending rearwardly from, the central shaft 182 at opposite ends of the idler roller 180 to dispose the dancer roller 186 for movement with the shaft 182 in an arcuate path intermediate the feed and pinch rollers 156, 168 and the idler roller 180. The leftward end of the shaft 182 extends outwardly beyond the left side wall 26 and is connected to the output side of a magnetic particle clutch 190 mounted to the frame 22. The input side of the magnetic particle clutch 190 is connected to an electric motor 191 which is continuously driven during normal operation of the napping machine. By varying the magnetic energy applied to the clutch 190, the amount of driving force of the motor 191 transmitted to the shaft 182 is variably controlled for selectively applying a biasing force to the shaft 182 upon energization of the motor 191 and clutch 190 to urge the dancer roller 186 upwardly in its arcuate range of movement. An electrically operated brake 192 is also connected to the shaft 182 for selectively holding the shaft 182 and, in turn, the dancer roller 186 in a fixed disposition upon energization of the brake 192. A shock absorber 194 (FIG. 6) is mounted at one end to the left side wall 26 of the frame 22 and at its opposite end to a bracket 196 affixed to the shaft 182 for dampening rotational movements thereof and, in turn, for dampening arcuate movement of the dancer roller 186.

The lower set of guide rollers 27 is of a substantially similar arrangement to the guide rollers 25. A feed roller 198 is rotatably supported between the side walls 24, 26 at their rearward edges and is chain driven from a drive motor 200, with a pinch roller 202 being rotatably supported in resting peripheral surface engagement with the feed roller 198 directly thereabove and driven therefrom by meshing respective drive gears 204, 206. An idler roller 208 is rotatably supported at a forward spacing from the feed and pinch rollers 198, 202 on a central shaft 210 rotatably journaled in the opposite frame side walls 24, 26. A dancer roller 186 is supported intermediate the idler roller 208 and the feed and pinch rollers 198, 202 by support arms 214 rigidly affixed to the shaft 210. The leftward end of the shaft 210 projects outwardly from the left side wall 26 and is connected through an electric brake 216 and a magnetic particle clutch 218 with a continuously operative electric drive motor 219, each of which are respectively mounted to the frame 22 and operative on the shaft 210 in the same manner as the clutch 190, motor 191 and brake 192 operate on the shaft 182 as above-described. Likewise, a shock absorber 220 is mounted between the side wall 26 and a bracket on the shaft 210 for dampening movements of the shaft 210 and the dancer roller 212.

The frame 22 is provided with suitable support locations 222, 224 whereat a roll of fabric 226 to be napped may be supported for delivery to the guide rolls and napping cylinder 25, 27, 28 and subsequently returned for winding about a take-up roll 228. In normal operation, a fabric F being napped follows a path of travel between the feed and take-up rolls 226, 228 as shown in FIG. 7, the fabric F initially being directed upwardly from the feed roll 226, forwardly over the pinch roller 168, rearwardly between the feed and pinch rollers 156, 168, forwardly beneath the feed roller 156, over the dancer roller 186, beneath the idler roller 180, forwardly, downwardly and then rearwardly about the forward peripheral extent of the napping cylinder 28, rearwardly over the idler roller 208, beneath the dancer roller 212, over the pinch roller 202, forwardly between the feed and pinch rollers 198, 202, and then downwardly to the take-up roll 228. During normal operation, the drive motor 191 is continuously driven and the clutch 190 is energized to bias the associated dancer roller 186 upwardly and, similarly, the drive motor 219 is continuously driven and the clutch 218 is energized to bias the associated dancer roller 212 downwardly to urge the dancer rollers 186, 212 into tensioning contact with the traveling fabric F.

As will be understood, movements of the dancer rollers 186, 212 during ongoing operation of the napping machine 20 indicate fluctuations in the tension in the fabric F. In operation of the present napping machine 20, it is considered advantageous and desirable to maintain a substantially constant level of fabric tension while at the same time maintaining a substantially constant speed of fabric travel through the machine. To accomplish these objectives, a potentiometer 230 is associated with the dancer roller 186 and, similarly, a potentiometer 232 is associated with the dancer roller 212 for respectively monitoring tension-responsive movements of each thereof as a basis for actuating compensating adjustments through the controller 125. (See FIGS. 2 and 4). Specifically, each potentiometer 230, 232 has a rotatable input shaft 234 to which a drive sprocket 236 is rigidly affixed. Each of the shafts 182, 210 to which the dancer rollers 186, 212 are affixed carries a driving sprocket 238, intermediate the respective clutch and brake on the shaft, which sprocket 238 is connected through a drive chain 240 in driving relationship to the potentiometer sprocket 236 of the associated potentiometer 230, 232. In this manner, movement of either dancer roller 186, 212 within its respective arcuate path of movement acts to rotate the input shaft 234 to the associated potentiometer 230, 232 which, in turn, produces a proportionately varying output signal related to the amount of dancer roller movement.

The output of each potentiometer 230, 232 is delivered to the controller 125 which is programmed to vary the speed of operation of the drive motors 104, 120 to the napping rollers 30 in correspondence to detected movements of the dancer roller 186 and to vary the speed of operation of the drive motor 200 to the feed roller 198 in correspondence to detected movements of the dancer roller 212. The controller 125, however, is programmed to maintain constant the speed of operation of the drive motor 92 for overall rotation of the napping cylinder 28 at a constant speed and also to maintain constant the speed of operation of the drive motor 160 to the feed roller 156 to maintain its rotational speed constant. Thus, the overall rate of travel of the fabric F through the napping machine 20 is maintained substantially constant while the fabric tension is kept substantially constant upstream of the napping cylinder 28 by varying the napping energy imparted to the fabric F by the napping rollers 30 in response to movements of the dancer roller 186 detected by the associated potentiometer 230 and downstream of the napping cylinder 28 by varying the driven speed of the feed roller 198 in response to movements of the dancer roller 212 detected by the associated potentiometer 232. During this operation, the shock absorbers 194, 220 dampen movements of the dancer rollers 186, 212 to minimize dramatic swings in the dancer rollers 186, 212 and, in turn, to minimize dramatic and repetitive adjustments in the operating parameters of the machine 20.

It is also considered advantageous in the operation of the present napping machine 20 that, upon any stoppage of the machine 20 during the course of normal fabric napping operation, the prevailing tension in the traveling fabric F should be maintained to prevent slackening of the extent of the fabric F about the napping cylinder 28 which may produce an unnapped, differentially napped, or otherwise defective section of fabric upon restart of the machine. Accordingly, the electric brakes 192, 216 associated with the dancer roller support shafts 182, 210 are arranged to be deactuated while electrical power is being supplied to the operating components of the napping machine 20 during its normal operation but to immediately actuate whenever electrical power to the machine operating components is shut off for stoppage of the machine. Thus, although a machine power stoppage de-energizes the clutches 190, 218 which otherwise would release any tensioning force by the dancer rollers 186, 212, against the fabric F, the brakes 192, 216 hold the dancer roller support shafts 182, 210 and, in turn, the dancer rollers 186, 212, in the same disposition they occupied when operating electrical power to the machine is terminated, thereby to maintain tensioning engagement of the dancer rollers 186, 212 with the fabric F.

The microprocessor-based controller 125 is programmed to execute a fabric thread-up procedure when setting up the napping machine 20 for operation on a new roll of fabric F. In the thread-up mode, the electric brakes 192, 216 are deactuated and the clutches 190, 218 are operated in reverse to rotate the shafts 182, 210 to move the associated dancer rolls 186, 212 fully away from the intended path of fabric travel, whereupon the brakes 192, 216 are actuated and the clutches 190, 218 are de-energized to hold the dancer rollers 186, 212 in such disposition. The drive motor 92 to the napping cylinder 28 and the drive motors 160, 200 to the feed rollers 156, 198 are actuated to drive rotation thereof at a very slow speed to assist a machine operator in threading the leading end of fabric F through the intended path of fabric travel previously described. At the same time, the drive motors 104, 120 to the napping rollers 30 are actuated to rotate the rollers 30 at the same surface speed as the napping cylinder 28 so that no napping energy is imparted to the fabric F during the thread-up procedure. Upon completion of fabric thread-up, the brakes 192, 216 are deactuated and the clutches 190, 218 are re-energized in their normal operating mode to bring the dancer rollers 186, 212 into biased tensioning engagement with the fabric F. Thereupon, normal operation of the napping machine may be actuated.

Figure 12:
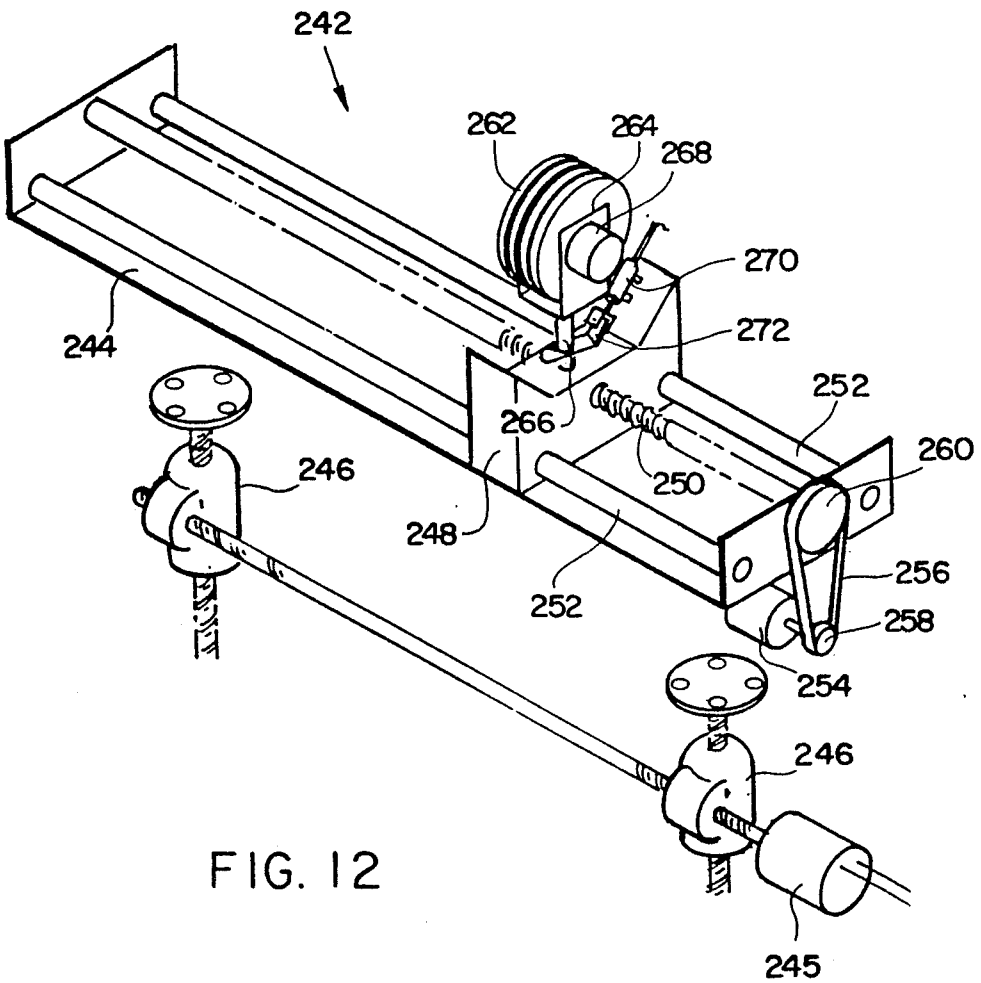
FIG. 12 is a perspective view of the cylinder grinding arrangement of the napping machine of FIG. 1.

As best seen in FIGS. 1, 7 and 12, the napping machine 20 is also equipped with a grinding mechanism, generally indicated at 242, mounted on the machine frame 22 immediately beneath the location occupied by the napping cylinder 28 in its operative position, to facilitate sharpening of the wire teeth of the napping rollers 30 without necessitating removal of the napping cylinder 28 from the napping machine 20. As shown in FIG. 12, the grinding mechanism 242 includes an elongate subframe 244 mounted directly beneath the napping cylinder 28 in substantially parallel relation to its axis by a pair of screw-type linear actuators 246 affixed to the frame 22 and commonly driven from a stepper motor 245. A carriage 248 is supported at the upper side of the subframe 244 in threaded driven engagement on an elongate drive screw 250 journaled at opposite ends of the subframe 244 and in sliding engagement on a laterally spaced pair of longitudinal guide rods 252 affixed at opposite ends of the subframe 244 in parallel relation to the drive screw 250. A drive motor 254 is affixed to the underside of the subframe 244 to selectively drive the screw 250 through a timing chain 256 trained about a drive sprocket 258 on the drive shaft of the motor 254 and a driven sprocket 260 on the drive screw 250, whereby the carriage 248 may be selectively driven back and forth along the length of the subframe 244. A set of abrasive grinding disks 262 are rotatably supported on a bracket 264 mounted on a shaft 266 rotatably supported at the center of the carriage 248. A drive motor 268 is also supported on the bracket 264 for driving rotation of the grinding disk 262. A pneumatic piston-and-cylinder assembly 270 is connected to a crank 272 affixed to the shaft 266 for selectively shifting the disposition of the bracket 264 between a pair of stop members (not shown) to adjust the orientation of the grinding disks 262 relative to the napping cylinder 28.

Thus, with the napping cylinder 28 in its operative position but with its main drive motor 92 deactuated, the grinding mechanism 242 may be elevated by the linear actuators 246 to bring the grinding disks 262 into grinding engagement with the wire teeth 48 of the napping roller 30 disposed at the lowermost side of the napping cylinder 28 and, upon actuation of the appropriate drive motor 104 or 120 for such napping roller and simultaneous actuation of the grinding disk drive motor 268 and the carriage drive motor 254, the grinding disks 262 are applied to the wire teeth 48 along the full axial and circumferential extent of the napping roller 30. At the completion of the forward reciprocation of the carriage 248 along the subframe 244, the piston-and-cylinder assembly 270 is actuated to change the orientation of the grinding disks 262 for the return reciprocation of the carriage 248 for grinding engagement with the opposite side of the wire teeth 48. In this manner, the teeth 48 may be sharpened to a chisel-like point for optimum napping effect. The drive motor 92 to the main napping cylinder 28 is actuated periodically to index the napping cylinder 28 by one napping roller 30 to accomplish sharpening of the wire teeth 48 of each napping roller 30.

As will thus be understood, the napping machine 20 of the present invention offers a number of distinct advantages over conventional napping machines. In particular, the novel mounting of the napping cylinder 28 on the pivotable support arms 50 together with the provision of the cylinder transport cart 66 enables napping cylinders to be changed on the machine in a matter of minutes with minimal down time of the machine thereby providing substantial flexibility in the employment of the napping machine 20. Likewise, the microprocessor-based control 125 for the various drive motors of the napping machine enables rapid and easy adjustment of the operating parameters of the machine such as fabric travel speed, peripheral speed of the main cylinder, and peripheral speeds of the napping rollers, enabling further flexibility in the napping effect achieved by the napping machine 20. The ability to periodically sharpen the wire teeth of the napping cylinder using the novel grinding mechanism of the present napping machine provides further efficiency in use of the napping machine 20 by eliminating the need to remove the napping cylinder from the machine for grinding, thereby further minimizing down time of the machine.

As will be understood, the foregoing advantages are realized in any embodiment of the present invention, whether in a full-scale commercial production napping machine or in the described embodiment in a reduced scale napping machine suitable for experimental, research-and-development, and laboratory usage. Furthermore, the reduced-scale embodiment of the napping machine as herein illustrated and described provides the additional advantages of enabling the user to easily experiment with differing napping effects of differing napping cylinders operated under differing settings of the operating components of the machine with differing fabrics, to otherwise simulate production napping conditions for purposes of analysis, and to produce sample yardage of napped fabrics, all with greater flexibility than possible with conventional commercial napping equipment and without necessitating the use of a full-scale commercial machine for such purposes.

For example, the present napping machine may be utilized to simulate the napping of a fabric through multiple differing napping operations, as is common in the commercial production of napped fabric, by seaming together the opposite ends of a relatively short length of fabric and passing the endless length of fabric through multiple cycles in the machine, with the machine settings being changed through the controller at the completion of each pass to correspond to differing napping procedures which would be successively performed on the fabric in a commercial production setting. Alternatively, the ends of individual lengths of differing fabrics may be seamed together and the joined fabrics processed through the napping machine as one fabric length, with any desirable changes in the machine settings being made through the microprocessor-based controller at the completion of each fabric section. To facilitate such uses of the present machine without necessitating stoppage and adjustment of the machine at each fabric seam, the napping machine 20 is provided with a seam detector 276 (FIG. 7) mounted along the path of fabric travel shortly in advance of the location of the feed and pinch rollers 156, 168, e.g., on a panel of a housing structure enclosing the operating components of the machine only representatively indicated at 278. To facilitate seam detection, fabric ends may be sewn together using a yarn having a thin metal wire component which may be detected by a conventional capacitance-type proximity detector. The seam detector 276, in turn, is operatively connected with the central controller 125 to signal recognition of a seam and thereby actuate any programmed change in the machine setting or operating parameters.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile napping machine of the type having a napping cylinder having a fabric raising surface at its periphery for engagement with a traveling textile fabric and drive means for rotating said napping cylinder, the improvement comprising means for supporting said napping cylinder for selective movement between an inoperative position wherein said napping cylinder is disengaged from driven relationship with said drive means for mounting and demounting said napping cylinder to and from said supporting means and an operative position wherein said napping cylinder is arranged in driven relationship with said drive means for rotative engagement with a traveling textile fabric.

2. In a textile napping machine according to claim 1 wherein said cylinder supporting means comprises arm means for rotatably supporting said cylinder, said arm means being pivotable between said operative and inoperative positions.

3. In a textile napping machine according to claim 1 wherein said drive means comprises a driving gear mounted at a stationary rotational axis and said napping cylinder comprises a driven gear for meshing engagement with said driving gear at said operative position.

4. In a textile napping machine according to claim 1 and further comprising means for detecting disposition of said napping cylinder in proper driven relationship with said drive means at said operative position and for disabling said drive means when said napping cylinder is out of proper driven relationship with said drive means.

5. In a textile napping machine according to claim 4 wherein said detecting means comprises feeler means positioned for engagement with a mating portion of said cylinder supporting means at said operative position.

6. In a textile napping machine according to claim 5 wherein said feeler means comprises a selectively extensible plunger mounted at a stationary disposition adjacent said operative position of said napping cylinder and said mating portion of said cylinder supporting means comprises an opening disposed for receiving said plunger substantially only when said cylinder supporting means is at said operative position, said feeler means and said drive means being operatively associated for disabling said drive means when said plunger is retracted from said opening and for enabling said drive means when said plunger is extended into said opening.

7. In a textile napping machine according to claim 1 and further comprising a traveling cart for transporting said napping cylinder to and from said napping machine for mounting and demounting of said napping cylinder, said cart being positionable adjacent said inoperative position in disposition for lateral transfer of said napping cylinder between said cart and said cylinder supporting means.

8. In a textile napping machine according to claim 7 wherein said cart and said napping machine comprise mating engagement members for docking said cart with said napping machine.

9. In a textile napping machine according to claim 7 wherein said cart comprises slide surfaces for alignment with cylinder support surfaces of said cylinder supporting means in said inoperative position for sliding movement of said napping cylinder into and out of mounted disposition on said cylinder supporting means.

10. In a textile napping machine according to claim 1 wherein said napping cylinder comprises indicia representing characteristics of said napping cylinder and said napping machine further comprises means for detecting said indicia to distinguish interchangeable napping cylinders from one another.

11. In a textile napping machine according to claim 10 wherein said napping cylinder comprises an identifying coaxial disk for integral rotation with said napping cylinder, said indicia being arranged at the periphery of said disk, and said detecting means is mounted in a fixed disposition adjacent said operative position of said napping cylinder for detecting said indicia during rotation of said napping cylinder.

12. In a textile napping machine according to claim 11 and further comprising means operative following mounting of said napping cylinder for rotating said napping cylinder at least one full revolution to enable said detecting means to identify said napping cylinder by its said indicia.

13. In a textile napping machine according to claim 1 and further comprising a plurality of guide rolls for training a fabric to travel to and from peripheral contact with said napping cylinder, said guide rolls being arranged for feeding the fabric to, and withdrawing the fabric from, said napping cylinder at the same side of said napping cylinder in said operative position.

14. In a textile napping machine according to claim 13 wherein said napping cylinder is disposed relatively closely adjacent said guide rolls in said operative position and relatively outwardly spaced from said guide rolls in said inoperative position.

15. In a textile napping machine according to claim 1 and further comprising a plurality of guide rolls for training a fabric to travel to and from peripheral contact with said napping cylinder, said guide rolls including a first dancer roll movable toward and away from the path of travel of the fabric in advance of said napping cylinder, means for biasing said first dancer roll into contact with the fabric, a second dancer roll movable toward and away from the path of travel of the fabric following said napping cylinder, and means for biasing said second dancer roll into contact with the fabric.

16. In a textile napping machine according to claim 15 and further comprising means for detecting movements of said first and second dancer rolls for monitoring tension fluctuations in the fabric.

17. In a textile napping machine according to claim 16 wherein said guide rolls include a driven feed roll in advance of said napping cylinder and a driven take-up roll following said napping cylinder, and characterized further by control means for adjusting the driven speed of one of said driven feed and take-up rolls in response to said detecting means.

18. In a textile napping machine according to claim 17 wherein said napping cylinder is of the type having a planetary arrangement of driven napping rollers spaced about the periphery of said napping cylinder, said control means being arranged for varying the driven speed of said napping rollers in response to movements of said first dancer roll detected by said detecting means and for varying the driven speed of said take-up roll in response to movements of said second dancer roll detected by said detecting means.

19. In a textile napping machine according to claim 18 wherein said control means is operative in a thread-up mode for deactuating each said biasing means to move said first and second dancer rolls away from the path of travel of said fabric, and for operating said feed roll, said napping cylinder and said take-up roll at relatively slow respective speeds without rotation of said napping rolls relative to said napping cylinder for facilitating thread-up of a fabric to be napped.

20. In a textile napping machine according to claim 15 and further comprising means associated with each said dancer roll for dampening movements thereof.

21. In a textile napping machine according to claim 15 and further comprising braking means operative upon a stoppage of said napping machine to maintain the prevailing disposition of said first and second dancer rolls.

22. In a textile napping machine according to claim 1 and further comprising means adjacent the path of travel of a fabric in advance of said napping cylinder for detecting a seam joining two ends of fabric to be napped.

23. In a textile napping machine according to claim 22 wherein said detecting means comprises means for detecting a metallic element at the fabric seam.

24. In a textile napping machine according to claim 1 wherein said fabric raising surface comprises fabric engaging teeth, and characterized further by means mounted on said napping machine for selectively grinding said teeth without removal of said napping cylinder from said napping machine.

25. In a textile napping machine according to claim 24 wherein said grinding means comprises a grinding member and means for selectively moving said grinding member radially toward and away from said napping cylinder for selective movement into and out of grinding engagement with said fabric raising surface.

26. In a textile napping machine according to claim 25 wherein said grinding means comprises means for moving said grinding member axially along said napping cylinder for grinding engagement with the full axial extent of said fabric raising surface.

27. In a textile napping machine according to claim 26 wherein said grinding member comprises a plurality of driven grinding disks.

28. In a textile napping machine according to claim 27 further comprising means for selectively adjusting the orientation of said grinding disks with respect to said teeth.

29. In a textile napping machine according to claim 1 wherein said napping cylinder comprises a planetary arrangement of driven fabric engaging rollers, at least one of said rollers comprising fabric engaging teeth and at least another one of said rollers comprising a fabric abrading surface.

30. In a textile napping machine according to claim 1 wherein said textile napping machine is of a relatively narrow width and relatively reduced scale in comparison to conventional commercial napping machines to be adapted for use for laboratory testing and other experimental napping operations.

* * * * *

UNITED STATES PATENT AND TRADEMARK OFFICE

CERTIFICATE OF CORRECTION

PATENT NO. : 5,084,948

DATED : Feb. 4, 1992

INVENTOR(S) : Arne Nielsen and Majid Moghaddassi

It is certified that error appears in the above-identified patent and that said Letters Patent is hereby corrected as shown below:

Column 4, Line 12, delete "move" and insert -- mode -- therefor.

Column 9, Line 57, delete "o" and insert -- on -- therefor.

Column 10, Lines 31-32, delete "cylinder support arms 5" and insert -- cylinder support arms 50 -- therefor.

Column 11, Line 37, delete "t" and insert -- to -- therefor.

Column 20, Line 5, before "further" add -- and --.

Signed and Sealed this

Twenty-fifth Day of May, 1993

*Attest:*

Michael K. Kirk

MICHAEL K. KIRK

*Attesting Officer*

*Acting Commissioner of Patents and Trademarks*